United States Patent [19]

Mansfield

[11] 4,218,167

[45] Aug. 19, 1980

[54] FEEDING APPARATUS FOR A MANUALLY DISABLED PERSON

[76] Inventor: Henry T. Mansfield, P.O. Box 434, Barnwell, S.C. 29812

[21] Appl. No.: 939,499

[22] Filed: Sep. 5, 1978

[51] Int. Cl.[3] ..... A61J 7/00

[52] U.S. Cl. ..... 414/9; 3/1; 30/323; 30/327; 128/222

[58] Field of Search ..... 414/9; 131/186; 401/6; 3/1, 12.8; 30/322, 323, 324, 327; 128/222; 224/42.46 R, 273; 239/33; 108/26

[56] References Cited

U.S. PATENT DOCUMENTS

| | | | |
|---|---|---|---|
| 319,098 | 6/1885 | Knauth | 30/323 |
| 1,881,701 | 10/1932 | Lambert | 131/186 |
| 2,546,463 | 3/1951 | Lustig et al. | 30/327 |
| 3,080,081 | 3/1963 | Gram | 30/324 X |
| 3,228,536 | 1/1966 | Gratzer | 414/9 |
| 3,391,830 | 7/1968 | Kitchens | 128/222 X |
| 3,653,775 | 4/1972 | Ross | 414/9 X |
| 3,885,681 | 5/1975 | Mancino | 414/9 |

OTHER PUBLICATIONS

"Long Handled Holder" Self-Help Devices for Rehabilitation; Institute of Physical Medicine and Rehabilitation; New York University.

*Primary Examiner*—L. J. Paperner

*Attorney, Agent, or Firm*—Larry Harold Kline

[57] ABSTRACT

A feeding apparatus is disclosed for a manually disabled person to eat food. The feeding apparatus may comprise an eating surface and a mouth-held implement, independent of the eating surface, and operative to place food on the eating surface whereby the manually disabled person may eat without assistance.

42 Claims, 11 Drawing Figures

FEEDING APPARATUS FOR A MANUALLY DISABLED PERSON

This invention relates to a feeding device and more particularly to a feeding device for persons having limited or no use of their arms and hands.

The device is designed to give independence and stability to the manually disabled diner. The present invention provides for the manually disabled person to eat without the constant assistance or supervision of other persons. This invention enables the manually disabled person to be more independent, and able to satisfy his own needs in eating rather than relying upon attendants, thereby increasing the psychological health of the user.

Several Patents have issued showing devices attempting to accomplish the above purposes. Some of these Patents are as follows: U.S. Pat. No. 3,907,126; U.S. Pat. No. 3,734,306; U.S. Pat. No. 3,317,061; U.S. Pat. No. 3,228,536; and U.S. Pat. No. 3,885,681.

Mancino U.S. Pat. No. 3,885,681 utilizes a mouthpiece. The present invention utilizes a specially designed mouthpiece with a chin rest and has many design features for stabilizing the eating operation. The present invention far exceeds the design of Mancino.

An object of the present invention is to provide a feeding device for a manually disabled person which gives the user independence in dining.

Another object of the present invention is to provide a feeding device for a manually disabled person which is stable.

A further object of the present invention is to provide a feeding device for a manually disabled person comprising a mouthpiece attached to a chin rest.

Still another object of the present invention is to provide a feeding device for a manually disabled person in which the disabled person may use different utensils for different purposes.

Another object of the present invention is to provide a feeding device for a manually disabled person which provides holding means and eating means for various food items on the same feeding device.

These and other objects and features of the invention will be apparent from the following description and appended claims.

Briefly, this invention is a feeding apparatus for a manually disabled person to eat food. The feeding apparatus comprises an eating surface and a mouth-held implement means independent of the eating surface. The mouth-held implement means is held in the mouth of the manually disabled person and operative to place food on the eating surface. The manually disabled person may eat a meal placed before the person without assistance. The mouth-held implement means comprises a mouthpiece, a chin rest and implement means. The mouthpiece is operative to be placed in the mouth of the manually disabled person. The chin rest is secured to the mouthpiece and operative to press against the face of the manually disabled person. The implement means is secured to the chin rest and is operative to hold the food. The mouthpiece comprises a large diameter end, a small diameter end, and sloping sides. The large diameter end is operative to be placed furtherest into the mouth of the manually disabled person. The small diameter end is secured against the chin rest. The sloping sides connect the large diameter end to the small diameter end. The design of the mouthpiece enables the manually disabled person to hold the mouthpiece securely in the mouth. The design of the mouthpiece enables the manually disabled person to breathe and talk freely and easily while utilizing the feeding apparatus. The chin rest comprises a center ring, an outer ring, and a plurality of stabilizing bars. The center ring is secured to the mouthpiece and to the implement means. The plurality of stabilizing bars connects the outer ring to the center ring. The chin rest presses against the face of the manually disabled person. The outer ring has a missing section, allowing space for the nose and preventing vision impairment of the manually disabled person. The implement means comprises a holding tip, a shaft, and a base. The holding tip is operative to hold the food. The shaft is connected to the holding tip and to the base. The implement means has a threaded connector secured to the bottom of the base. The mouth-held implement means further comprises a threaded opening in the small diameter end of the mouthpiece and an opening in the center ring of the chin rest. The implement means may be secured to the chin rest and the mouthpiece by passing the threaded connector through the opening in the center ring, and securing it within the threaded opening in the small diameter end of the mouthpiece. The chin rest further comprises a pin emanating from the back of the center ring. The implement means contains a hole within which the pin is secured. The pin is located on a vertical plane of the chin rest. The implement means may be a fork means. When the implement means is a fork means, the hole within which the pin is secured is located on the vertical plane of the fork means identical to the vertical plane of the pin of the chin rest. The implement means may be a spoon means. When the implement means is a spoon means, the hole within which the pin is secured is located on a vertical plane of said spoon means different from the vertical plane of the chin rest. The spoon means will be angled with respect to the mouthpiece and chin rest for easier utilization by the manually disabled person. The pin may be located on the chin rest in the vertical center plane of the chin rest. The feeding apparatus further comprises a feeding table, a plurality of openings within the feeding table and a plurality of connectors operative to be placed within the pluraity of openings. The manually disabled person may, by use of the mouth-held implement means, move food from the plurality of containers to the eating surface in order to eat. The feeding apparatus may further comprise a first stand opening within the feeding table and a first slot opening connected to the first stand opening within the feeding table. A first variable-elevated stand is operative to secure the eating surface onto the feeding table. A first variable-elevated stand comprises a first base and a first extension emanating from the first base. The first base secures within the first stand opening. The first extension secures within the first slot opening. The first variable-elevated stand is, therefore, secured from axial movement. the first variable-elevated stand is operative to secure the eating surface to the feeding table. A second variable-elevated stand is operative to secure a holding means to the feeding table. The feeding apparatus further comprises a second stand opening and a second slot opening. The second variable-elevated stand secures within the second stand opening and second slot opening. A plurality of suction cups may be connected to the feeding table in order to secure the feeding table to a stable surface. The first variable-elevated stand comprises a first shaft and a first elevating means operative to vary the length of the first shaft. A first securing means is connected to the first shaft to secure the eating surface to the first variable-elevated stand. A second variable-elevated stand is operative to secure the holding means to the feeding table. A second variable-elevated stand comprises a second base and a second extension emanating from the second base. A second stand opening and a second slot opening connected to the second stand opening is within the feeding table. The second base secures within the second stand opening. The first extension secures within the first slot opening. The second variable-elevated stand is, therefore, secured from axial movement. The second variable-elevated stand comprises a second shaft connected to the second base and a second elevating means operative to vary the length of the second shaft. A second securing means is connected to the second shaft and secures a holding means to the second variable-elevated stand. The holding means comprises a holder shaft securable to the second variable-elevated stand. A lower section is connected to the holder shaft. Tension means is operative to secure a lower section to an upper section. An extension is connected to the upper section. The extension may be pressed by a helper of the manually disabled person in order to place certain types of food between the lower section and the upper section. The upper section comprises an upper back and two upper side pieces. The lower section comprises a lower back and two lower side pieces. The manually disabled person may be able to eat the portion of the food which is located between the two upper side pieces and the two lower side pieces. A laminated gripping agent may be placed on the surface of the sides of each of the plurality of openings in the feeding table. One of the plurality of containers may contain support means for holding the mouth-held implement means. The support means may comprise a ridge in the container bottom of one of the plurality of containers. The ridge may be curved. Support means may further comprise a top ridge connected to the rim of the plurality of containers. The top ridge may have an indentation. The holding tip of the implement means presses against the ridge of the container bottom. The shaft of the implement means presses into the indentation of the top ridge. The feeding apparatus may further comprise one or more container tops. The container tops comprise a gripping edge operative to secure the container top to the container. A center section with a plurality of stabilizing ribs extending therefrom are located on the container top. A straw opening is within the center section. A straw may be placed through the straw opening and utilized to remove fluid types of food from the container.

The invention will be more fully understood from the following detailed description and appended claims when taken with the drawings in which:

Figure 10:
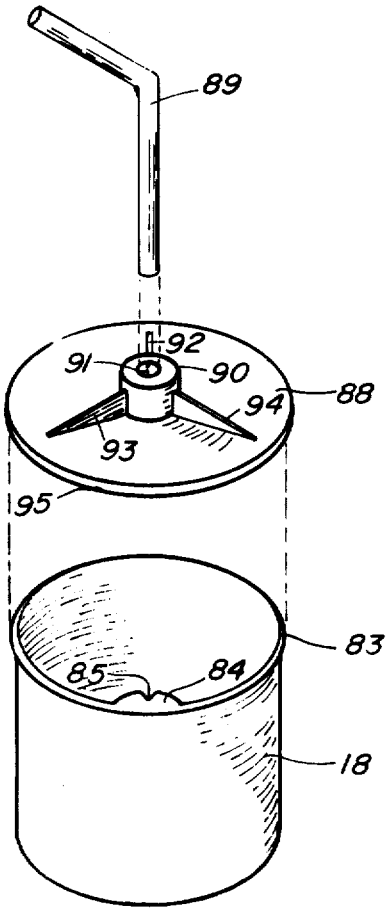

FIG. 10 is an isometric view of bowl 18 with a lid 88 and straw 89 exploded therefrom.

Figure 11:
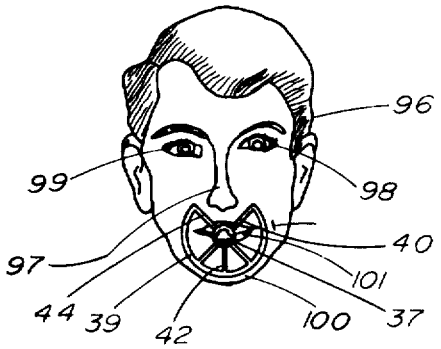

FIG. 11 is a pictorial view of a person holding mouthpiece 27 in his mouth 101.

Figure 1:
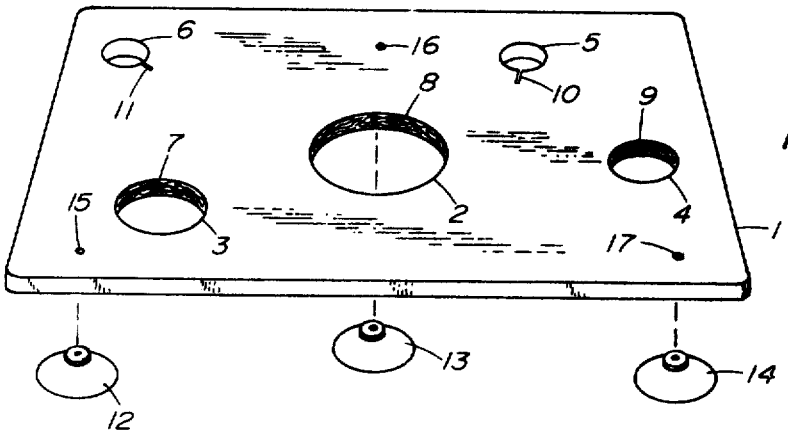
FIG. 1 is an isometric view of table 1 showing the suction cups exploded away from the table.

Referring now to the drawings, FIG. 1 shows an isometric view of table 1. Suction cups 12, 13 and 14 are shown exploded away from table 1. Table 1 has openings 2, 3, 4, 5 and 6. Opening 2 has a laminated gripping agent 8 on the sides of the opening 2 within table 1. Opening 3 has a laminated gripping agent 7 on the sides of the opening 3 within table 1. Opening 4 has a laminated gripping agent 9 on the sides of the opening 4 within table 1. Opening 5 has connected to it a stabilizing slot 10. Opening 6 has connected to it a stabilizing slot 11. Bolt 15 is used to secure suction cup 12 to table 1. Bolt 16 is used to secure suction cup 13 to table 1. Bolt 17 is used to secure suction cup 14 to table 1.

Figure 2:
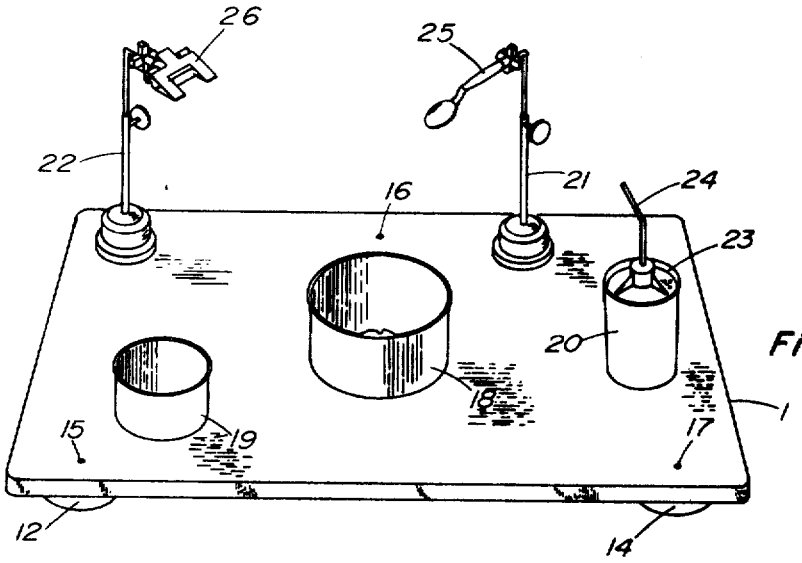
FIG. 2 is an isometric view of table 1 with the openings in the table filled with eating implements.

FIG. 2 is an isometric view of table 1 with the openings in the table filled with eating implements. Large bowl 18 is placed in opening 2. Bowl 19 is placed in opening 3. Glass 20 is placed in opening 4. Variable-elevated stand 21 is placed in opening 5. Variable-elevated stand 22 is placed in opening 6.

Glass 20 in opening 4 on table 1 has a top 23 with a stabilizing design. Top 23 has an opening through which straw 24 extends. Spoon 25 is attached to variable-elevated stand 21. Holder 26 is attached to the variable-elevated stand 22.

Figure 3:
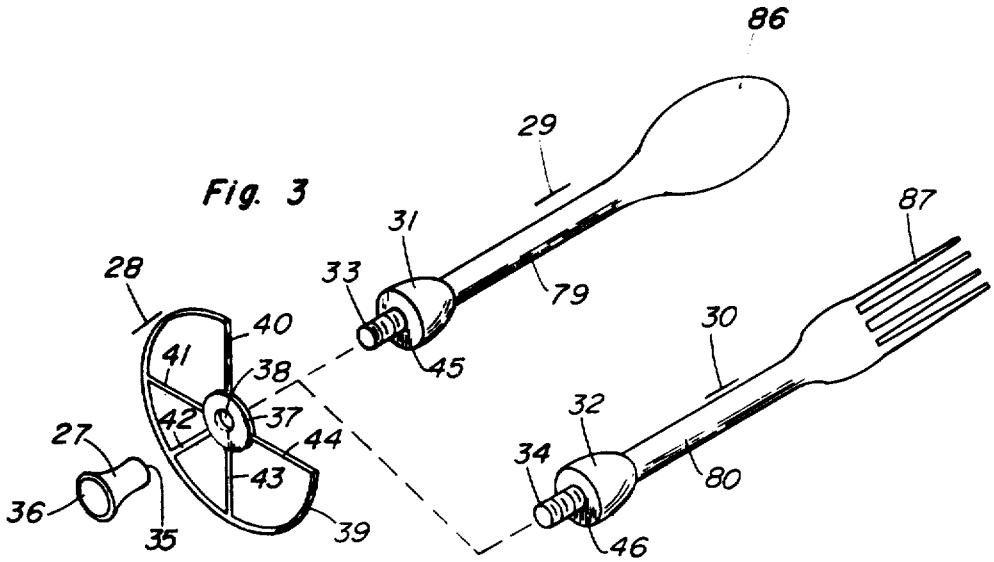
FIG. 3 is an exploded, isometric view of the mouthpiece and chin rest showing the fork device and spoon device which may be utilized therewith.

FIG. 3 shows an exploded, isometric view of the mouthpiece 27 and chin rest 28 showing spoon device 29 and fork device 30. Spoon device 29 comprises base 31 and threaded shaft 33. Base 31 has a bottom 45. Spoon device 29 also has spoon shaft 79 and spoon tip 86.

Fork device 30 comprises base 32 and threaded shaft 34. Base 32 has a bottom 46. Fork device 30 also comprises fork shaft 80 and fork tip 87.

Threaded shafts 33 and 34 may extend through opening 38 to be secured to mouthpiece 27.

Mouthpiece 27 has a large end 36 and a small end 35. Mouthpiece 27 is designed with the large end 36 for deepest penetration into the mouth, and sloping sides sloping down to small end 35 in order to provide greater holding ability within the mouth of a manually disabled person.

Chin rest 28 comprises center ring 37 and outer ring 39. Stabilizing bars 40, 41, 42, 43 and 44 connect center ring 37 to outer ring 39. Center ring 37 has an opening 38. Outer ring 39 is circular, but does not run between stabilizing bars 40 and 44.

Figure 4:
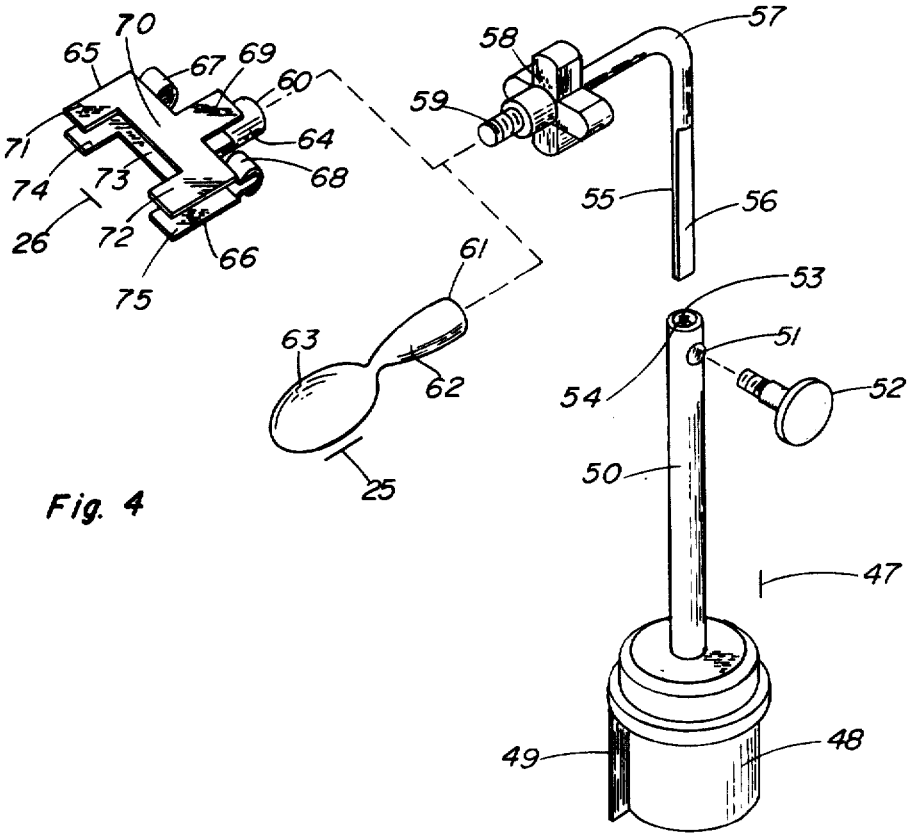
FIG. 4 is an exploded, isometric view showing the variable-elevated stand with a spoon and a holder which may be utilized therewith.

FIG. 4 is an exploded, isometric view showing a variable-elevated stand 47 with spoon 25 and holder 26. Variable-elevated stand 47 may be either variable-elevated stand 21, or variable-elevated stand 22. Variable-elevated stand 47 comprises base 48 with extension 49 and hollow shaft 50 extending from base 48. Extension 49 fits within stabilizing slot 10 of opening 5, or stabilizing slot 11 of opening 6. Slots 10 and 11 are shown in FIG. 1.

Base 48 is comparatively heavy with respect to the rest of variable-elevated stand 47; therefore, the heavy base 48, along with extension 49 in a stabilizing slot, such as slots 10 or 11, provides for a stable variable-elevated stand 47.

Hollow shaft 50 has a threaded hole 51 within which thumb screw 52 may be secured. Hollow shaft 50 has an opening 53 with a flattened side 54. Elbow shaft 57 comprises a shaft 55 with a flattened side 56. Shaft 55 secures within opening 53. Flattened side 56 of shaft 55 fits against flattened side 54 of opening 53. Thumb screw 52 may be tightened within threaded hole 51 against flattened side 56 in order to secure elbow shaft 57 to hollow shaft 50. Elbow shaft 57 may be raised or lowered as desired, to be tightened or re-tightened by thumb screw 52. Variable-elevated stand 47, therefore, may have various elevations as desired. Elbow shaft 57 connects to tightening device 58 by use of threaded section 59. Holder 26 or spoon 25 can be secured to the threaded section 59.

Holder 26 comprises a threaded opening 60 in shaft 64. Shaft 64 is connected to the lower section 66 of holder 26. The upper section 65 of holder 26 is secured to the lower section 66 by tension means 67 and 68. The upper section of 65 has an extension 69. Extension 69 is pressed by a helper in order to place food items between the upper section 65 and the lower section 66.

Upper section 65 has an upper back 70, side piece 71, and side piece 72. Lower section 66 has a bottom back 73, side piece 74, and side piece 75. Food items, such as bread or toast, may be placed between upper section 65 and lower section 66 and held securely by the side piece 71 pressing toward side piece 74, side piece 72 pressing toward side piece 75, and upper back 70 pressing toward bottom back 73. Holder 26 is designed so that the manually disabled person may be able to bite the food substance which is held between the side pieces. Therefore, with no eating assistance, the disabled person may be able to eat the majority of the item being held in holder 26.

Spoon 25 comprises threaded opening 61, shaft 62 and eating surface 63. Threaded section 59 of tightening device 58 secures within threaded opening 61 when spoon 25 is attached to variable-elevated stand 47.

Figure 5:
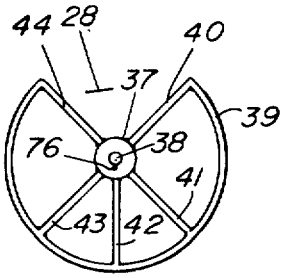
FIG. 5 is a back view of chin rest 28.

FIG. 5 shows a back view of chin rest 28. Chin rest 28 comprises outer ring 39 and center ring 37 with opening 38. Stabilizing bars 40, 41, 42, 43 and 44 connect outer ring 39 to center ring 37. Outer ring 39 does not extend between stabilizing bars 40 and 44. A pin 76 extends from center ring 37. Pin 76 is utilized to aid the stability of the device attached to chin rest 28.

Figure 6:
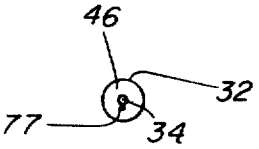
FIG. 6 is a front view of the base 32 of fork 30.

FIG. 6 is a front view of the base 32 of fork 30. Base 32 has a bottom 46. Extending from bottom 46 is threaded shaft 34. Below the threaded shaft 34 is hole 77. Hole 77 is designed to receive pin 76; therefore, when fork device 30 is secured to chin rest 28, pin 76 fits within hole 77, securing and stabilizing the device.

Figure 7:
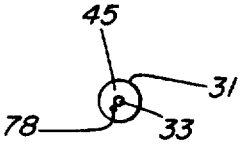
FIG. 7 is a front view of the base 31 of spoon 29.

FIG. 7 is a front view of a the base 31 of spoon device 29. Base 31 has a bottom 45. Threaded shaft 33 extends from bottom 45. Below threaded shaft 33 is hole 78. Hole 78 is not directly below threaded shaft 33, by design. Pin 76 will fit within hole 78 and act to secure the spoon device 29 to chin rest 28. Since hole 78 is not directly below threaded shaft 33, the spoon tip 86 will actually be held at a slight angle with respect to the chin rest 28 as it is shown in FIG. 5. Applicant has discovered that by holding the spoon device 29 at an angle, it is easier to operate for the purposes of the present invention. It may be held at any angle desired, or may be aligned as is fork device 30.

Figure 8:
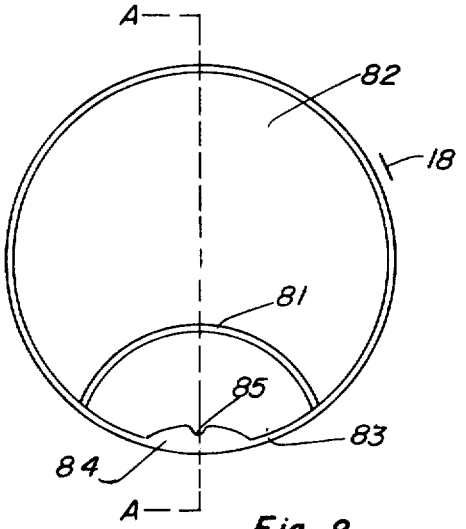
FIG. 8 is a top view of bowl 18.

FIG. 8 is a top view of bowl 18. Bowl 18 is designed for various purposes. It may or may not have a lid. It may be used for various types of foods, including soft or firm foods. It is designed to hold a utensil device, such as spoon device 29 or fork device 30, in a stable position. When holding a utensil, the utensil tip, such as spoon tip 86 or fork tip 87, would fit beneath curved ridge 81 in the bottom 82 of bowl 18. The utensil shaft, such as spoon shaft 79 and fork shaft 80, would rest in indentation 85 on ridge 84 which extends from rim 83 of bowl 18.

Figure 9:
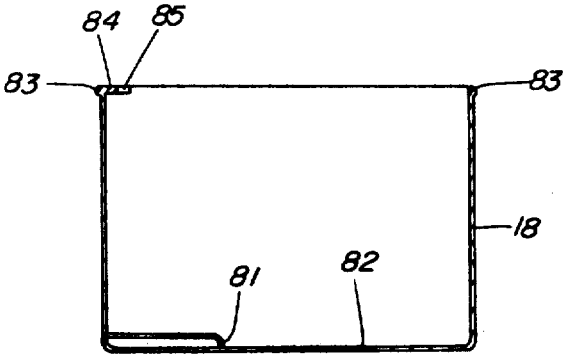
FIG. 9 is a sectional view of FIG. 8 at Section A-A.

FIG. 9 is a sectional view of FIG. 8 at Section A-A. FIG. 9 further shows how curved ridge 81 is positioned in the bottom 82 of bowl 18. Indentation 85 is shown in ridge 84 which extends from rim 83.

FIG. 10 is an isometric view of bowl 18 with a lid 88 and a straw 89 exploded from the bowl 18. Lid 88 has a center section 90. Center section 90 has a hole 91. Stabilizing ribs 92, 93 and 94 extend from center section 90. A straw 89 may be secured within hole 91 in lid 88. By use of the straw 89 and the lid 88, a person may utilize bowl 18 for soup or other liquid food items. Lid 88 has gripping edge 95 which secures lid 88 to the rim 83 of bowl 18. Top 23 shown on the glass 20 in FIG. 2 is of the same design as lid 88 in FIG. 10.

FIG. 11 is a pictorial view of a person holding mouthpiece 27 in his mouth 101. FIG. 11 shows a person's head 96 with features including nose 97, eyes 98 and 99, chin 100 and mouth 101. Mouthpiece 27 is within mouth 101 of the person. Chin rest 28 rests against the chin 100 and the mouth 101. The opening in the outer ring 39 between stabilizing bars 40 and 44 allows position for the nose of the person. This opening prevents blockage of the vision of the person who is looking down at the food. The design of the mouthpiece 27, sloping from a large end 36 to a small end 35, enables the person to hold the device securely in the mouth, pressing the chin rest 28 against the face. The device is so stable that the person may actually talk while holding the device within his mouth 101. Stabilizing bars 40, 41, 42, 43 and 44 help to stabilize the entire device by pressing against the chin and face while pressure within mouth 101 pulls the mouthpiece 27 back into the mouth 101.

A manually disabled person may be anyone who has any sort of affliction or disability in which use of the hands is impaired. The present invention allows this person to have an independent, stable meal in a somewhat relaxing atmosphere of solitude. The present feeding device allows the user to have a variety of food items.

To utilize the present invention, food items may be placed within bowls 18 and 19. A liquid food or drink may be placed within glass 20. Bread, toast, or some other food item may be placed in holder 26. Spoon device 29 or fork device 30, or any other implements may be connected to chin rest 28 and mouthpiece 27. The user would place mouthpiece 27 within his mouth 101 and by use of the implement, remove food items from bowl 18 or bowl 19. These items would then be placed on eating surface 63 of spoon 25. The implement device would then be placed within bowl 18 and be stabilized there by curved ridge 81 and indentation 85, as previously discussed. The user would then eat the food item on eating surface 63 of spoon 25, could drink through straw 24 the liquids within glass 20 and eat whatever item that is being held by holder 26. This process can be repeated until the meal is completed.

When the mouth-held implement means is placed on the feeding table 1, the mouthpiece 27 itself does not touch the table 1. The mouthpiece 27 is secured to the chin rest 28 so that the mouthpiece 27 is projected from the chin rest 28 above the table 1. The manually disabled person may easily place the mouthpiece 27 within the mouth 101 because the mouthpiece 27 itself is always in the air and easily accessible. The mouthheld implement means may also be weighted so that the open area between the stabilizing bars 40 and 44 is in proper position for the face of the manually disabled person.

The feeding table 1 may be moved from a serving cart to an eating area without removing the plurality of containers which are located in the plurality of openings. This feature makes it easier to serve the manually disabled person by simply removing the feeding table 1 from a serving cart, or other portable device, and placing it in an area where the manually disabled person can eat, utilizing the present invention without further assistance.

The eating surface does not have to be connected to the feeding table. It could be any independent, stabilized surface desired. It would be placed close enough to the manually disabled person for convenience. Any number of containers could be utilized. Any number of variable-elevated stands could be utilized. The mouthpiece 27 and chin rest 28 are designed so that the manually disabled person may easily breathe and even talk while the person is manipulating the mouth-held implement means. This invention fulfills all of the objectives sought by the inventor. It gives the manually disabled person independence in dining. It provides an apparatus which is stable. It provides a stabilized, mouth-held implement means, providing different utensils, as desired. The invention gives the manually disabled person a method of eating a variety of food items in a manner which, considering the user's disabilities, is comfortable and satisfying.

While the invention has been described with reference to specific embodiments, the description is illustrative and is not be be construed as limiting the scope of the invention. Various modifications and changes may occur to those skilled in the art without departing from the spirit and scope of the invention as defined by the appended claims.

I claim:

1. A feeding apparatus for a manually disabled person to eat food comprising:

(a) an eating surface;

(b) a mouth-held implement means independent of said eating surface, held in the mouth of said manually disabled person, and operative to place said food on said eating surface;

(c) a mouthpiece operative to be placed in said mouth of said manually disabled person;

(d) a chin rest secured to said mouthpiece and operative to press against the face of said manually disabled person whereby the amount of pressure on said chin rest is applied by said mouth to control said mouth-held implement means; and (e) an implement means secured to said chin rest and operative to hold said food;

whereby said manually disabled person may eat a meal placed before said person without assistance.

2. A feeding apparatus according to claim 1 wherein said mouthpiece comprises:

(a) a large diameter end operative to be placed furtherest into said mouth of said manually disabled person;

(b) a small diameter end secured against said chin rest; and (c) sloping sides connecting said large diameter end to said small diameter end, whereby said manually disabled person may hold said mouthpiece securely in said mouth.

3. A feeding apparatus according to claim 1 wherein said chin rest comprises:

(a) a center ring secured to said mouthpiece and to said implement means;

(b) an outer ring; and (c) a plurality of stabilizing bars connecting said outer ring to said center ring, whereby said chin rest presses against said face of said manually disabled person.

4. A feeding apparatus according to claim 1 wherein said implement means comprises:

(a) a holding tip operative to hold said food;

(b) a shaft connected to said holding tip;

(c) a base connected to said shaft;

(d) a bottom on said base; and (e) a threaded connector secured to said bottom of said base connectable to said mouthpiece.

5. A feeding apparatus according to claim 1 wherein:

(a) said mouthpiece comprises:

(1) a large diameter end operative to be placed furtherest into said mouth of said manually disabled person; and (2) a small diameter end secured against said chin rest; and (3) sloping sides connecting said large diameter end to said small diameter end, whereby said manually disabled person may hold said mouthpiece securely in said mouth;

(b) said chin rest comprises:

(1) a center ring secured to said mouthpiece and to said implement means;

(2) an outer ring; and (3) a plurality of stabilizing bars connecting said outer ring to said center ring, whereby said chin rest presses against said face of said manually disabled person;

(c) said implement means comprises:

(1) a holding tip operative to hold said food;

(2) a shaft connected to said holding tip;

(3) a base connected to said shaft;

(4) a bottom on said base; and (5) a threaded connector secured to said bottom of said base.

6. A feeding apparatus according to claim 5 wherein said mouth-held implement means further comprises:

(a) a threaded opening in said small diameter end of said mouthpiece; and (b) an opening in said center ring of said chin rest, whereby said implement means may be secured to said chin rest and said mouthpiece by said threaded connector passing through said opening in said center ring and being secured within said threaded opening in said small diameter end of said mouthpiece.

7. A feeding apparatus according to claim 3 wherein said chin rest further comprises a pin emanating from the back of said center ring.

8. A feeding apparatus according to claim 7 wherein said implement means contains a hole within which said pin is secured.

9. A feeding apparatus according to claim 7 wherein said pin is located on a vertical plane of said chin rest.

10. A feeding apparatus according to claim 9 wherein said implement means is a fork means and said hole within which said pin is secured is located on the vertical plane of said fork means identical to said vertical plane of said pin of said chin rest.

11. A feeding apparatus according to claim 9 wherein said implement means is a spoon means and said hole within which said pin is secured is located on a vertical plane of said spoon means, differing from said vertical plane of said pin and said chin rest whereby said spoon means will be angled with respect to said mouthpiece and said chin rest for easier utilization by said manually disabled person.

12. A feeding apparatus according to claim 11 wherein said vertical plane of said chin rest wherein said pin is located is the vertical center plane of said chin rest.

13. A feeding apparatus according to claim 1 further comprising:

(a) a feeding table;

(b) a plurality of openings within said feeding table; and (c) a plurality of containers operative to be placed within said plurality of openings, whereby said manually disabled person may, by use of said mouth-held implement means, move said food from said plurality of containers to said eating surface to eat.

14. A feeding apparatus according to claim 1 further comprising:

(a) a feeding table;

(b) a first stand opening within said feeding table; and (c) a first slot opening connected to said first stand opening within said feeding table operative for stabilizing an object in said first stand opening.

15. A feeding apparatus according to claim 14 further comprising a first variable-elevated stand operative to secure said eating surface onto said feeding table.

16. A feeding apparatus according to claim 15 wherein said first variable-elevated stand comprises a first base and a first extension emanating from said first base, whereby said first base secures within said first stand opening within said feeding table, and said first extension secures within said first slot opening, thereby securing said first variable-elevated stand from axial movement.

17. A feeding apparatus according to claim 13 further comprising:

(a) a first variable-elevated stand operative to secure said eating surface to said feeding table; and (b) a second variable-elevated stand operative to secure a holding means onto said feeding table.

18. A feeding apparatus according to claim 17 further comprising:

(a) a first stand opening within said feeding table;

(b) a first slot opening connected to said first stand opening within said feeding table;

(c) a second stand opening within said feeding table; and (d) a second slot opening connected to said first stand opening within said feeding table, whereby said first variable-elevated stand secures within said first stand opening and said first slot, and said second variable-elevated stand secures within said second stand opening and said second slot.

19. A feeding apparatus according to claim 17 further comprising a plurality of suction cups connected to said feeding table and operative to secure said feeding table to a stable surface.

20. A feeding apparatus according to claim 16 wherein said first variable-elevated stand comprises:

(a) a first shaft connected to said first base;

(b) a first elevating means operative to vary the length of said first shaft of said first variable-elevated stand; and (c) a first securing means connected to said first shaft and operative to secure said eating surface to said first variable-elevated stand.

21. A feeding apparatus according to claim 15 further comprising a second variable-elevated stand operative to secure a holding means onto said feeding table.

22. A feeding apparatus according to claim 21 wherein said feeding apparatus further comprises a second stand opening within the feeding table and a second slot opening connected to the second stand opening within the feeding table; the second variable-elevated stand comprising a second base and a second extension emanating from the second base, whereby the second base secures within the second stand opening and the second extension secures within the second slot opening, thereby securing the second variable-elevated stand from axial movement.

23. A feeding apparatus according to claim 22 wherein said second variable-elevated stand comprises:

(a) a second shaft connected to said second base;

(b) a second elevating means operative to vary the length of said second shaft of said second variable-elevated stand; and (c) a second securing means connected to said second shaft and operative to secure said eating surface to said second variable-elevated stand.

24. A feeding apparatus according to claim 17 wherein said holding means comprises:

(a) a holder shaft securable to said second variable-elevated stand;

(b) a lower section connected to said holder shaft;

(c) an upper section;

(d) tension means operative to secure said lower section to said upper section; and (e) an extension connected to said upper section, whereby said extension may be pressed by a helper of said manually disabled person in order to place certain types of said food between said lower section and said upper section of said holding means.

25. A feeding apparatus according to claim 24 wherein said upper section comprises an upper back and two upper side pieces, and said lower section comprises a lower back and two lower side pieces, whereby said manually disabled person may be able to eat the portion of said food which is located between the two upper side pieces and two lower side pieces.

26. A feeding apparatus according to claim 13 further comprising a laminated gripping agent placed on the surface of the sides of each of said plurality of openings within said feeding table.

27. A feeding apparatus according to claim 13 wherein one of said plurality of containers comprises support means for holding said mouth-held implement means.

28. A feeding apparatus according to claim 27 wherein said support means comprises a ridge in the container bottom of said one of said plurality of containers.

29. A feeding apparatus according to claim 28 wherein said ridge is curved.

30. A feeding apparatus according to claim 28 wherein said support means further comprises a top ridge connected to the rim of said one of said plurality of containers.

31. A feeding apparatus according to claim 30 further comprising an indentation in said top ridge connected to said rim of said one of said plurality of containers.

32. A feeding apparatus according to claim 31 wherein said mouth-held implement means comprises:

(a) a mouthpiece operative to be placed in said mouth of said manually disabled person;

(b) a chin rest secured to said mouthpiece and operative to press against the face of said manually disabled person whereby the amount of pressure on said chin rest is applied by said mouth to control said mouth-held implement means; and (c) an implement means secured to said chin rest and operative to hold said food.

33. A feeding apparatus according to claim 32 wherein said implement means comprises:

(a) a holding tip operative to hold said food;

(b) a shaft connected to said holding tip;

(c) a base connected to said shaft;

(d) a bottom on said base; and (e) a threaded connector secured to said bottom of said base connectable to said mouthpiece, whereby said holding tip presses against said ridge in said container bottom of said one of said plurality of containers, and said shaft presses into said indentation in said top ridge connected to said rim of said one of said plurality of containers.

34. A feeding apparatus according to claim 13 further comprising a first container top operative to be placed on a first container in said plurality of containers.

35. A feeding apparatus according to claim 34 wherein said first container top comprises:

(a) a first gripping edge operative to secure said first container top to said first container;

(b) a first center section;

(c) a first plurality of stabilizing ribs extending from said first center section;

(d) a first straw opening within said center section, whereby fluid types of said food may be removed from said first container through said first straw opening.

36. A feeding apparatus according to claim 35 further comprising a first straw which may be placed through said first straw opening and utilized to remove said fluid types of said food from said first container through said first straw opening.

37. A feeding apparatus according to claim 34 further comprising a second container top operative to be placed on a second container in said plurality of containers.

38. A feeding apparatus according to claim 37 wherein said second container top comprises:

(a) a second gripping edge operative to secure said second container top to said second container;

(b) a second center section;

(c) a second plurality of stabilizing ribs extending from said second center section;

(d) a second straw opening within said center section, whereby fluid types of said food may be removed from said second container through said second straw opening.

39. A feeding apparatus according to claim 38 further comprising a second straw which may be placed through said second straw opening and utilized to remove said fluid types of said food from said second container through said second straw opening.

40. A feeding apparatus according to claim 3 wherein a section of said center ring is removed in order to provide space for the nose and for proper vision of said manually disabled person.

41. A feeding apparatus according to claim 19 wherein said feeding table may be moved from a serving cart on which said feeding table is secured, to an eating area wherein said feeding table may be secured by said plurality of suction cups with said plurality of containers placed within said plurality of openings, whereby none of said plurality of containers must be removed in order to move said feeding table.

42. A feeding apparatus according to claim 13 wherein said mouth-held implement means comprises:

(a) a mouthpiece operative to be placed in said mouth of said manually disabled person;

(b) a chin rest secured to said mouthpiece and operative to press against the face of said manually disabled person;

(c) an implement means secured to said chin rest and operative to hold said food; and (d) said mouthpiece secured to said chin rest whereby when said mouth-held implement means rests on said feeding table, said chin rest touches said table, but said mouthpiece is projected from said chin rest above said table so that said manually disabled person may easily place said mouthpiece within said mouth in order to easily take hold of said mouth-held implement means.

* * * * *